United States Patent [19]

Rice et al.

[11] 4,346,556

[45] Aug. 31, 1982

[54] INSULATING ENGINE EXHAUST PORT LINER

[75] Inventors: Hal H. Rice, Birmingham; Gary A. Kruger, Troy, both of Mich.

[73] Assignee: General Motors Corporation, Detroit, Mich.

[21] Appl. No.: 148,904

[22] Filed: May 12, 1980

[51] Int. Cl.[3] ..... F01N 7/14; F01N 7/16; F01N 7/18

[52] U.S. Cl. ..... 60/272; 60/282; 123/193 H; 138/145; 138/149; 428/36; 428/428

[58] Field of Search ..... 60/272, 282; 123/193 H; 138/145, 146, 141, 149; 428/426, 428, 284, 285, 432, 36; 501/16, 20, 54, 95, 133

[56] References Cited

U.S. PATENT DOCUMENTS

| | | | |
|---|---|---|---|
| 2,703,486 | 3/1955 | Ford | 428/428 |
| 3,488,723 | 1/1970 | Veazie | 60/282 |
| 3,709,772 | 1/1973 | Rice | 60/282 |
| 3,718,497 | 2/1973 | Rice | 501/20 |
| 3,771,967 | 11/1973 | Nowak | 60/299 |
| 3,798,903 | 3/1974 | Mitchell | 60/282 |
| 3,919,755 | 11/1975 | Kaneko | 138/145 |
| 3,957,519 | 5/1976 | Linton | 501/133 |
| 4,056,399 | 11/1977 | Kirkpatrick | 501/133 |
| 4,195,478 | 4/1980 | Rao | 123/193 H |
| 4,254,621 | 3/1981 | Nagumo | 123/193 H |

*Primary Examiner*—Douglas Hart
*Attorney, Agent, or Firm*—Robert J. Outland

[57] ABSTRACT

An insulating liner for use in an exhaust port of an internal combustion engine or the like consisting, in a preferred embodiment, of a formed thin wall tubular body of rigidized fibrous ceramic such as fibrous alumina-silica material (Fiberfrax) with an abrasion resistant ceramic coating fused onto the inner gas-exposed surface of the body. The coating comprises a mixture of fused silica cement and fine glass frit sintered in place on the body inner surface at a temperature below that which would damage the thin walls of the body.

3 Claims, 4 Drawing Figures

INSULATING ENGINE EXHAUST PORT LINER

TECHNICAL FIELD

This invention relates to heat retaining insulating liners for engine exhaust ports and the like and more particularly to lightweight thin wall fibrous ceramic liners coated internally with an abrasion resistant ceramic material.

BACKGROUND

It is known in the internal engine combustion art to provide means for insulating engine exhaust port walls to retard the loss of heat from the engine exhaust gases. One purpose, among others, of such constructions is to retain heat in the engine exhaust gases to improve the performance of connected emission control equipment, such as catalytic converters or thermal reactors.

Among arrangements which have been proposed for reducing heat loss through the engine exhaust port walls is the provision of suitable liners in the exhaust ports. Various constructions have been proposed including sheet metal liner inserts and liners of various hardened ceramic materials. It is desirable that such liners be resistant to corrosion and abrasion from the exhaust gases which pass therethrough and that they be of adequate strength and light weight (low mass) to provide extended life without adding excessively to the overall weight of the engine. The insulating characteristics of the liner are, of course, also important.

SUMMARY OF THE INVENTION

Recognizing that exhaust port liners made of hardened ceramic materials are generally of relatively high mass, we have developed improved ceramic exhaust port liners made of ceramic fiber material which have low mass as well as excellent thermal insulating characteristics, superior to those of the usual hardened ceramics.

Unfortunately, fibrous ceramics, even when heavily rigidized with collodial silica, do not possess adequate resistance to erosion caused by the passage of hot exhaust gases and particulates in the gases associated with internal combustion gasoline and diesel engines. One metod we have found for making adequately erosion resistant fibrous ceramic components is to coat a preformed fibrous ceramic body with fused silica cement, after which the surface is heated by a torch, such as oxy-propane, to melt the fused silica coat. While this method is useful for some parts, it is not applicable to thin walled exhaust port liners having wall thicknesses on the order of 3.8 mm because of the resultant melting and distortion of the underlying fibrous ceramic body.

Furnace sintering of the fused silica cement coating on highly rigidized fibrous ceramic (Fiberfrax) at 1027° C. was not successful in providing an erosion resistant surface. However, the 1027° C. temperature represents the approximate upper limit to which thin walled fibrous ceramic (Fiberfrax) shapes can be heated before shrinkage and distortion begin.

Bearing in mind the foregoing heating limitations, we discovered that mixing a suitable proportion of fine powdered glass frit with fused silica cement results in a coating material for thin walled fibrous ceramic (Fiberfrax) parts which has the necessary erosion resistance after furnace sintering at 1027° C. Test results indicate that coated ceramic fiber exhaust port liners formed in this manner provide erosion resistance nearly as high as the torch fused silica cement and ample for application in engine exhaust systems.

These and other features and advantages of the invention will be more fully understood from the following description of a preferred embodiment taken together with the accompanying drawing.

BEST MODE DISCLOSURE

Figure 1:
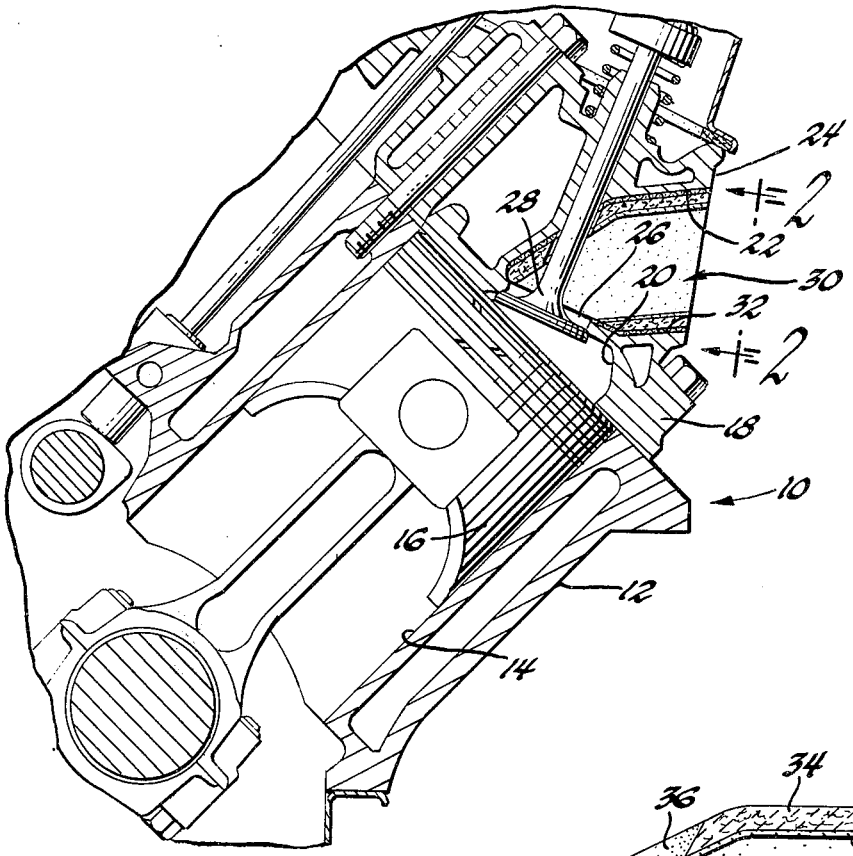
FIG. 1 is a fragmentary cross-sectional view of an internal combustion engine showing the construction of one of the cylinders and the associated exhaust port including an insulating exhaust port liner formed in accordance with the invention.
Figure 2:
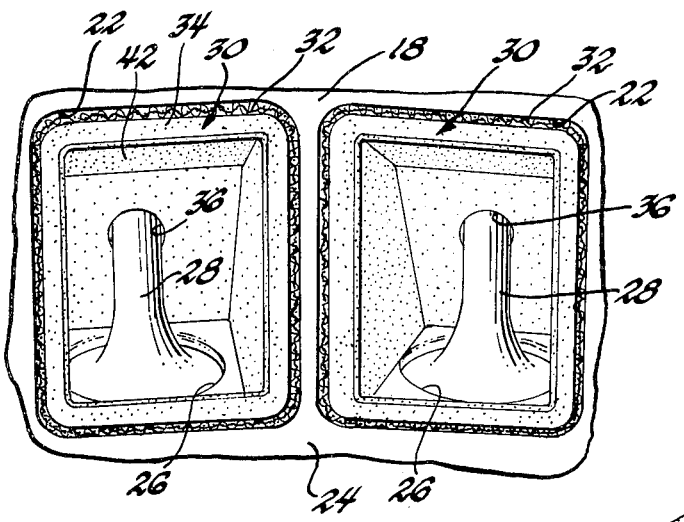
FIG. 2 is a side view of the exhaust manifold mounting face of the engine as seen from the plane indicated by the line 2—2 of FIG. 1.
Figure 3:
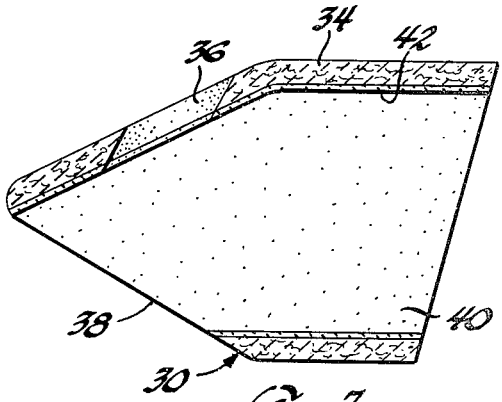
FIG. 3 is an enlarged cross-sectional view taken along the path of gas flow through an exhaust port liner formed in accordance with the invention.
Figure 4:
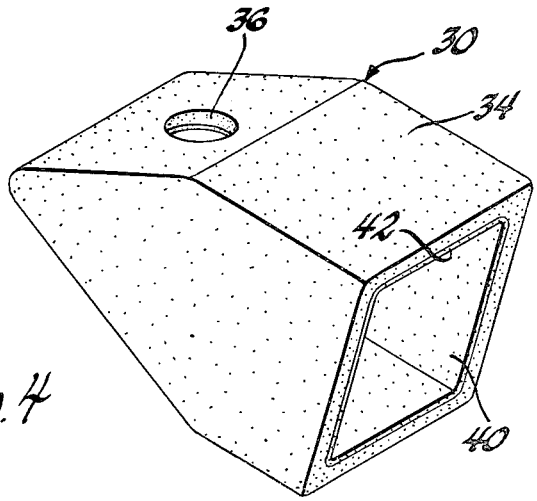
FIG. 4 is a pictorial view of the exhaust port liner of FIG. 3.

Referring now to the drawing in detail, numeral 10 generally indicates an internal combustion engine having a cylinder block 12 defining a plurality of cylinders 14 containing pistons 16. A cylinder head 18 is mounted on the cylinder block, closing the upper ends of the cylinders and defining with them and their respective pistons, enclosed combustion chambers 20. The cylinder head 18 includes inlet and exhaust means communicating with each of the combustion chambers, including exhaust ports 22 extending from a manifold mounting wall 24 inwardly to openings 26 that communicate with the combustion chambers and are closed conventionally by poppet exhaust valves 28.

Within each of the exhaust ports associated with the various cylinders of the ingine, there is disposed an insulating exhaust port liner 30. Each liner is retained snugly within its respective exhaust port by one or more pieces of woven wire mesh sheet 32 formed of nickel steel wire or the like and placed between the sides of the port and the associated insert so as to be resiliently deformed upon installation of the insert in the port. Subsequent installation of the exhaust valves within the cylinder head and the assembly of an exhaust manifold, not shown, against the manifold mounting wall 24 further serve to positively retain the inserts 30 within their respective exhaust ports.

Each of the port liners associated with the various exhaust ports of the engine comprises a thin wall preformed fibrous ceramic body 34 formed from any suitable high temperature insulating fibrous ceramic material. A suitable example is a fibrous alumina-silica material available commercially from the Carborundum Company under the tradename Fiberfrax.

The preformed body 34 is made with walls having generally the shape of the exhaust port within which it is to be installed and with a suitable wall thickness which may be on the order of 3.8 mm. The body 34 is rigidized in an appropriate manner, such as with collodial silica, so that it will maintain its shape during installation and subsequent operation in the engine under varying high temperature conditions.

The preformed body is provided either before or after rigidizing with a suitable opening 36 to accommodate the stem of the associated exhaust valve. The body defines a tubular passage having open ends 38, 40 through which exhaust gases may pass.

In order to provide the passage defining wall surfaces of the tubular port liner 30 with adequate resistance to erosion by hot engine exhaust gases and the particulate matter contained therein, the inner surfaces of the port liners are covered with a sintered coating 42 formed in accordance with the invention.

Coating 42 preferably consists of fused silica cement and powdered glass frit in a mixture formed with the ingredients and proportions indicated in Table I. The resulting mixture is coated onto the inner surfaces of each of the port liners. These are then heated in a furnace at 1027° C., thereby sintering the coating, which, upon cooling, forms an erosion and abrasion resistant surface without damage or deformation of the preformed port liner walls. The approximate chemical composition of the preferred exhaust port liner coating material, excluding the associated water, is given in Table II.

TABLE I

Exhaust Port Liner Coating Material

| Ingredient | Part by Weight |
|---|---|
| Fused Silica Cement (89.6% solids)* | 56 |
| P-1409 Glass Frit Powder** | 50 |
| Water | 35 |
| Darvan C*** (Suspension Agent) | 0.5 |

*Harbison-Walker Refractories, Division of Dresser Industries, Inc.
**Pemco Division, SCM Corporation; alkaline earth alumino-borosilicate, 5% retained on 200 mesh sieve.
***R. T. Vanderbilt Co., Inc. ammonium salt of a polyelectrolyte.

TABLE II

Chemical Composition of Exhaust Port Liner Coating

| Oxide | Percent by Weight |
|---|---|
| CaO | 1.1 |
| MgO | 5.2 |
| $Al_2O_3$ | 7.2 |
| $B_2O_3$ | 14.5 |
| $SiO_2$ | 72.0 |
| Total | 100.0 |

While the invention has been described by reference to a specific embodiment chosen for purposes of illustration, it should be understood that numerous changes could be made without departing from the spirit and scope of the inventive concepts disclosed. The fibrous ceramic insulating and ceramic coating materials specifically recited are exemplary only and the substitution of similar equivalent materials is contemplated. Accordingly, it is intended that the invention not be limited except by the language of the following claims.

The embodiments of the invention in which an exclusive property or privilege is claimed are defined as follows:

1. An insulating exhaust port liner for internal combustion engines and the like, said liner comprising a formed thin wall body of rigidized fibrous ceramic of relatively low mass and high insulating value, said body being shaped to define at least part of the inner wall of a high temperature exhaust gas passage, and an abrasion resistant ceramic coating fused onto at least the inner gas-exposed surface of said body, said coating comprising a mixture of fused silica cement and fine glass frit sintered in place on the body inner surface at a temperature below that which will damage the thin walls of the body.

2. An insulating exhaust port liner for internal combustion engines and the like, said liner comprising a formed thin wall body of rigidized fibrous alumina-silica ceramic of relatively low mass and high insulating value, said body being shaped to define at least part of the inner wall of a high temperature exhaust gas passage, and an abrasion reistant ceramic coating fused onto at least the inner gas-exposed surface of said body, said coating comprising a mixture of fused silica cement and fine glass frit sintered in place on the body inner surface at a temperature below that which will damage the thin walls of the body.

3. An exhaust port liner according to claim 2 wherein the walls of the formed alumina-silica body have a thickness on the order of 3.8 mm and the abrasion resistant silica glass coating thereon is a mixture in approximate proportions by weight of 56 parts fused silica cement and 50 parts fine glass frit powder.

* * * * *